US009785118B2

(12) United States Patent
Christan et al.

(10) Patent No.: US 9,785,118 B2
(45) Date of Patent: Oct. 10, 2017

(54) BALANCE SPRING STUD-HOLDER

(71) Applicant: ETA SA Manufacture Horlogere Suisse, Grenchen (CH)

(72) Inventors: Julien Christan, Bienne (CH); Laurent Kaelin, Sonvilier (CH); Ivan Villar, Brugg (CH); Thierry Conus, Lengnau (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/964,970

(22) Filed: Dec. 10, 2015

(65) Prior Publication Data

US 2016/0179059 A1 Jun. 23, 2016

(30) Foreign Application Priority Data

Dec. 22, 2014 (EP) ..... 14199751

(51) Int. Cl.

| | |
|---|---|
| ***G04B 17/32*** | (2006.01) |
| ***G04D 1/04*** | (2006.01) |
| ***G04B 18/02*** | (2006.01) |
| ***G04D 1/06*** | (2006.01) |

(52) U.S. Cl.

CPC ..... *G04D 1/06* (2013.01); *G04B 17/325* (2013.01); *G04B 18/021* (2013.01); *G04D 1/04* (2013.01)

(58) Field of Classification Search

CPC ..... G04B 17/32; G04B 17/325; G04B 18/02; G04B 18/021; G04B 18/023; G04D 1/04; G04D 1/06

USPC ..... 368/178

See application file for complete search history.

(56) References Cited

U.S. PATENT DOCUMENTS

2015/0138934 A1* 5/2015 Courvoisier ..... G04B 17/325 368/178

2015/0177689 A1* 6/2015 Capt ..... G04B 17/325 368/178

FOREIGN PATENT DOCUMENTS

CH 609 515 3/1979

OTHER PUBLICATIONS

European Search Report dated Sep. 7, 2015 in European Application 14199751, filed on Dec. 22, 2014 ( with English Translation).

* cited by examiner

*Primary Examiner* — Vit W Miska

(74) *Attorney, Agent, or Firm* — Oblon, McClelland, Maier & Neustadt, L.L.P.

(57) ABSTRACT

The present invention concerns an assembly for holding or supporting a timepiece balance spring including a balance spring stud and a stud-holder, wherein said stud-holder includes:

a base comprising an upper face and a lower face extending along a longitudinal axis;

characterized in that the base includes a lug of non-constant shape protruding from one of the faces, said assembly further comprising a holding plate including a first opening and a second opening separated by a deformable arm, with the stud engaging in the second opening.

23 Claims, 8 Drawing Sheets

BALANCE SPRING STUD-HOLDER

This application claims priority from European Patent Application No 14199751.0 filed on Dec. 22, 2014; the entire disclosure of which is incorporated herein by reference.

The present invention concerns an assembly for holding or supporting a timepiece balance spring including a balance spring stud and a stud-holder, wherein said stud-holder includes:

a base comprising a first stop member extending along a longitudinal axis of said base;

means of securing said stud-holder to an escapement mechanism.

PRIOR ART

In a mechanical watch, it is usual to use a regulating member comprising a sprung-balance device. Conventionally, the inner end of the balance spring is attached to a collet provided on the balance staff. In order to attach and position the inner end of the balance spring, it is known to use a stud-holder housing a balance spring stud, in association with a clamping screw to clamp the stud against the portion of the balance spring engaged in the stud-holder.

In such an assembly, the stud-holder is conventionally attached to a balance-cock also used for attaching one of the ends of the balance staff. In practice, during assembly and/or timing, the operations to be performed with these various elements are difficult, since access is restricted and the parts are of very small dimensions. Moreover, with such configurations, it is common for the balance spring clamping screw or the balance spring stud-holder to come loose, and/or be lost during an operation such as adjustment of the active length of the balance spring.

SUMMARY OF THE INVENTION

It is an object of the invention to overcome the drawbacks of the prior art by proposing to provide an assembly for holding or supporting a timepiece balance spring which allows simplified assembly or disassembly of the balance spring stud.

To this end, the invention concerns an assembly for holding or supporting a timepiece balance spring including a balance spring stud and a stud-holder, wherein the stud-holder includes:

a base comprising an upper face and a lower face extending along a longitudinal axis;

characterized in that the base comprises a lug forming a protuberance from one of said faces, said assembly further comprising a holding plate including a first opening and a second opening separated by a deformable arm, the stud engaging in the second opening, said first opening being arranged to cooperate with the lug, the cross-section of the lug having a shape such that a rotation of said holding plate causes a deformation of the deformable arm constricting the second opening and clamping the stud.

The invention also concerns an assembly for holding or supporting a timepiece balance spring including a balance spring stud and a stud-holder, wherein said stud-holder includes:

a base comprising an upper face and a lower face extending along a longitudinal axis and a first opening;

characterized in that the base includes a second opening separated from said first opening by a deformable arm, the stud engaging in the second opening, said assembly further including a lug arranged to cooperate with said first opening, the cross-section of the lug has a shape such that a rotation of the lug causes a deformation of the deformable arm constricting the second opening and clamping the stud.

The invention also concerns an assembly for holding or supporting a timepiece balance spring including a balance spring stud and a stud-holder, wherein said stud-holder includes:

a base comprising an upper face and a lower face extending along a longitudinal axis and a hole;

characterized in that the base includes a holding plate provided with a first opening and a second opening separated by a deformable arm, the stud engaging in the second opening, said assembly further including a lug arranged to cooperate with said first opening and the hole allowing the holding plate to be fixed on the base, the shape of the cross-section of said lug having such that a rotation of the lug causes a deformation of the deformable arm constricting the second opening and clamping the stud.

In a first advantageous embodiment, the first opening is circular, said lug taking the form of a cylindrical part wherein at least one area of the outer wall has a protuberance for application of stress on the deformable arm to reduce the size of the second opening.

In a second advantageous embodiment, the first opening and said lug have an elliptical shape, the main axis of said lug being offset angularly with respect to the longitudinal axis of the base for application of stress on the deformable arm to reduce the size of the second opening.

In a third advantageous embodiment, the first opening and said lug have an elliptical shape, the main axis of said first opening being offset angularly with respect to the longitudinal axis of the base for application of stress on the deformable arm to reduce the size of the second opening.

In a fourth advantageous embodiment, the base includes a recess in which a shock absorber system is placed.

In a fifth advantageous embodiment, the recess is placed such that the central axis of the recess coincides with the axis of the lug.

In a sixth advantageous embodiment, the lug includes a recess in which a shock absorber system is placed.

In another advantageous embodiment, the hole in the base is blind, said base comprising a recess positioned such that the central axis of the recess coincides with the axis of the lug, in which a shock absorber system is placed.

In another advantageous embodiment, said assembly further includes a male interface arranged on the holding plate and a female interface arranged on said lug in order to secure the holding plate to said lug.

In another advantageous embodiment, said assembly further includes a male interface arranged on the base and a female interface arranged on said lug in order to secure the lug to said base.

In another advantageous embodiment, the assembly further includes a male interface arranged on the holding place and a female interface arranged on said lug in order to secure the lug to said base.

In another advantageous embodiment, the male interface and the female interface are screw threads.

In another advantageous embodiment, the female interface comprises in the thickness thereof at least one cavity formed by a passage which is parallel to the central axis of the lug and open on the lower surface of the lug, and, secant with said first passage and opposite the upper surface, a blind slot used for locking the holding plate in a bayonet fitting.

In another advantageous embodiment, the female interface comprises in the thickness thereof at least one cavity formed by a passage which is parallel to said central axis of the lug and open on the upper surface of the lug, and, secant with said first passage and opposite the lower surface, a blind slot used for locking the holding plate in a bayonet fitting.

In another advantageous embodiment, the holding assembly further includes adjustment means comprising a toothed wheel arranged on the balance cock cooperating with a toothing arranged on the holding plate, said wheel being provided with a slot so that a tool can rotate said toothed wheel, causing the holding plate to rotate.

In another advantageous embodiment, the holding assembly further includes adjustment means comprising a first notch arranged on the balance cock and a second notch arranged on the holding plate, the first notch and the second notch being arranged such that a tool inserted in the first and second notch can rotate the holding plate with respect to the balance cock.

BRIEF DESCRIPTION OF THE DRAWINGS

The objects, advantages and features of the invention will appear more clearly in the following detailed description of at least one embodiment of the invention, given solely by way of non-limiting example and illustrated by the annexed drawings, in which.

DETAILED DESCRIPTION

The present invention proceeds from the general idea of providing an assembly for holding or supporting a timepiece balance spring permitting simpler assembly/disassembly of the balance spring stud.

Figure 1:
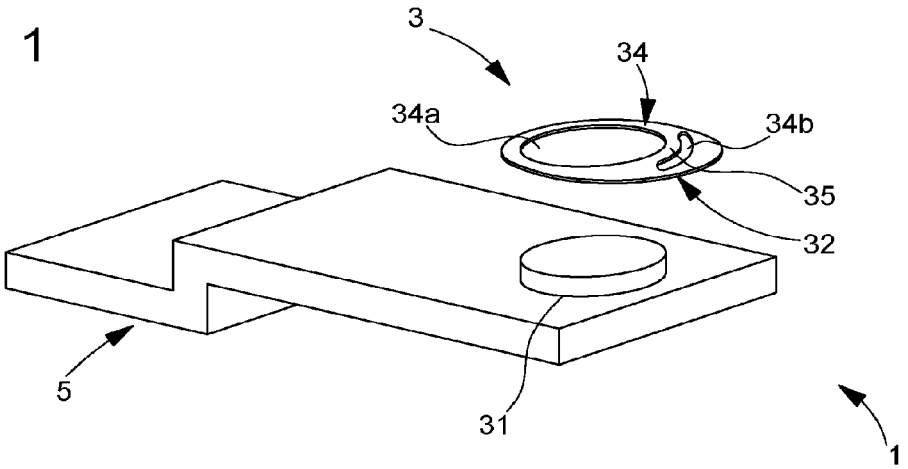
FIGS. 1 and 2 show a diagram of a first embodiment of the holding assembly according to the invention.

In a first embodiment seen in FIG. 1 there is shown a schematic view of an assembly 1 for holding or supporting a timepiece balance spring according to a first embodiment. This holding assembly 1 includes a stud-holder 3 arranged to be attached to the balance-cock 5, also referred to as the base; the latter has a longitudinal axis D. The holding assembly also includes a balance spring stud 9 attached to one coil of the balance spring. Stud-holder 3 is used to secure the stud to the cock.

Figure 2:
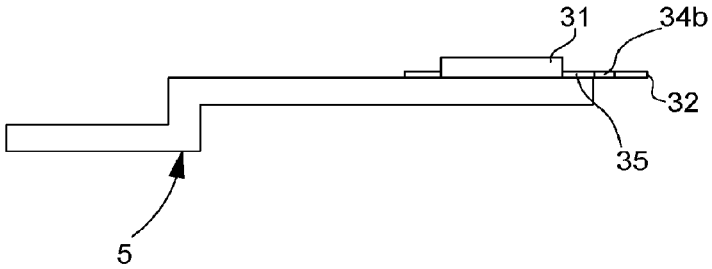

In this first embodiment seen in FIGS. 1 and 2, stud-holder 3 is composed of a holding plate 32. Balance cock 5 includes a lug 31 forming a protuberance. This holding plate 32 is a plate pierced with an orifice 34. Holding plate 32 further includes a deformable bar 35 separating orifice 34 into a first opening 34*a* and a second opening 34*b*.

First opening 34*b* is the largest portion and is arranged to cooperate with lug 31. This means that lug 31 is inserted into first opening 34*a*. Second opening 34*b* is used for stud 9. In fact, stud 9 is inserted in second opening 34*b*.

Advantageously according to the invention, the shape of lug 31 and that of first opening 34*a* are such that they can act on deformable bar 35 when the holding plate rotates with respect to said lug. This deformation of said bar makes it possible to constrict second opening 34*b* and thereby clamp the stud.

Figure 3A:
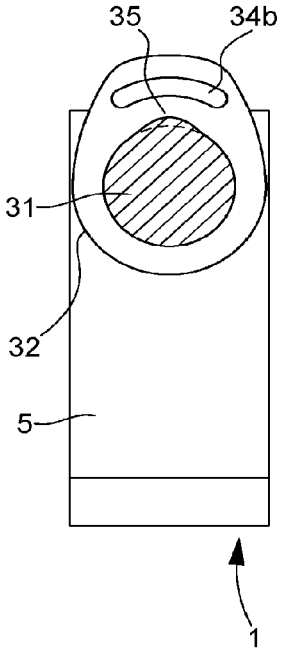
FIGS. 3*a* to 3*c* show a diagram of a first solution of the first embodiment of the holding assembly according to the invention.
Figure 3B:
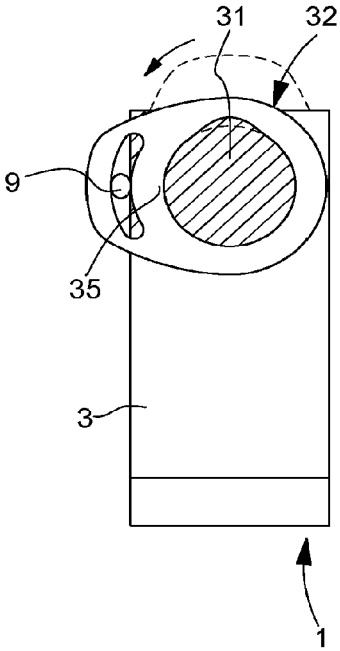
Figure 3C:
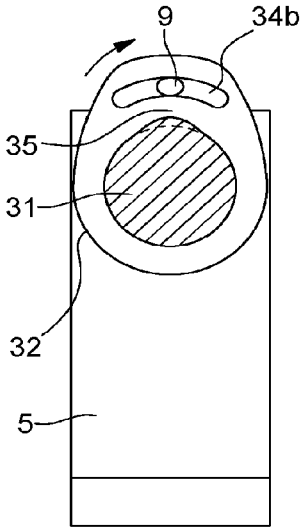

In a first solution seen in FIGS. 3*a*, 3*b* and 3*c*, the first portion 34*a* is devised to have a perfectly circular shape, with second portion 34*b* taking the form of a curved groove. In this first solution, lug 31 takes the form of a part with a non-constant cross-section. More specifically, lug 31 will be made to take the form of a substantially circular part having a central axis C wherein one area exhibits a greater distance between the centre of the circle and the end of lug 31, which provides a separate area as seen in FIG. 3*a*

This separate area will be used for clamping stud 9. Indeed, by pivoting holding plate 32 with respect to lug 31 the separate area of lug 31 will enter into contact with deformable bar 35. Given that first opening 34*a* is circular, the separate area of lug 31 exerts a stress on deformable bar 35. This stress thus deforms bar 35 which constricts second opening 34*b*. This constriction causes stress to be exerted on stud 9 so as to clamp said stud.

Assembly is achieved by mounting plate 32 on cock 5 and inserting lug 31 in first opening 34*a* of holding plate 32. Holding plate 32 may or may not be mounted in its permanent angular position. Lug 31 could be provided with a peripheral groove to prevent uncoupling of holding plate 32. In the case where holding plate 32 is mounted in its permanent angular position, holding plate 32 will be pivoted at a certain angle clockwise or anticlockwise so that the separate area is no longer in contact with deformable bar 35. The stress applied by this separate area is thus removed and second opening 34*b* returns to its original size as seen in FIG. 3*b*.

Stud 9 is then placed in second opening 34*b* and holding plate 32 is rotated with respect to lug 31 to constrict second opening 34*b* and clamp stud 9 on holding plate 32, as seen in FIG. 3*c*.

Lug 31 could be devised as a circular part provided with a projecting portion or a part of ovoid shape.

Figure 4:
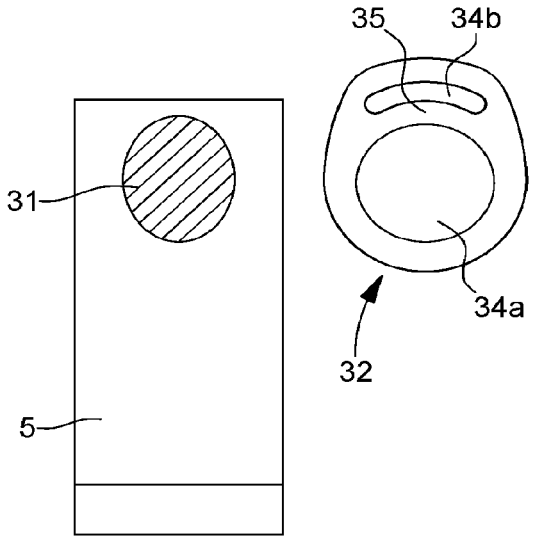
FIGS. 4 and 5 show a diagram of a second solution of the first embodiment of the holding assembly according to the invention.
Figure 5:
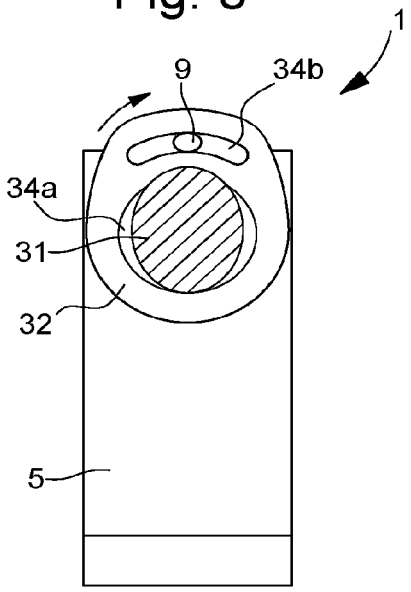

In a second solution seen in FIGS. 4 and 5, first opening 34*a* is devised to have an elliptical shape, with second opening 34*b* taking the form of a curved groove. This elliptical shape makes it possible to obtain an elliptical lug 31. This ellipse has a main axis, called the focal axis, passing through the foci and a secondary axis perpendicular to the focal axis and passing through the centre of the segment formed by the two focal points of said ellipse. In this second solution, lug 31 takes the form of a part of identical cross-section to that of first opening 34*a*, as seen in FIG. 4.

However, lug 31 is arranged such that its main axis extends parallel to the longitudinal axis of cock 5, as seen in FIG. 4. Consequently, during assembly of holding plate 32, lug 31 is inserted in first opening 34*a*. As a result, holding plate 32 is in an angularly offset position with respect to alignment with the longitudinal axis of cock 5. This is due to the fact that, when plate 32 and cock 5 are perfectly aligned, lug 31 and first opening 34*a* of plate 32, which have an identical shape, do not coincide and are offset angularly.

When holding plate 32 is rotated in order to clamp stud 9 inserted in second opening 34*b*, one of the two poles, i.e. one of the two areas the farthest from the centre of lug 31, enters into contact with deformable bar 35. Deformable bar 35 is then subjected to stress from lug 31, causing the deformation of said bar 35. This deformation of said bar 35 causes a constriction of second opening 34*b* and thus the appearance of stress on stud 9 which clamps the stud as seen in FIG. 5.

Figure 6:
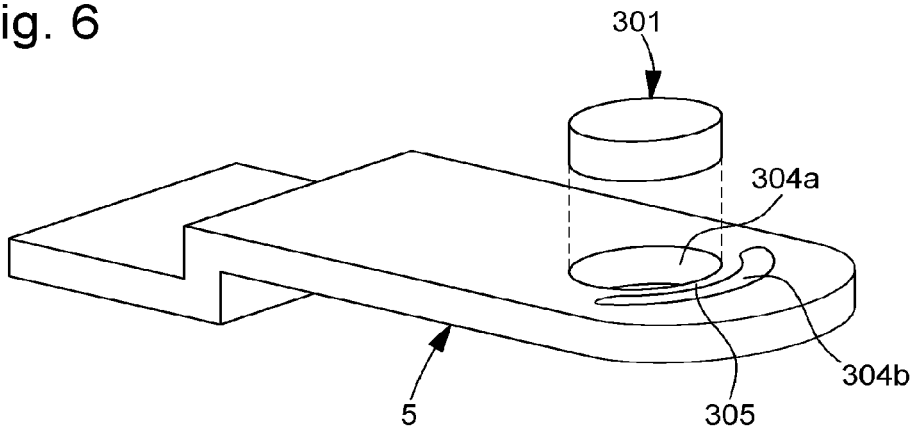
FIG. 6 shows a diagram of a second embodiment of the holding assembly according to the invention.

In a second embodiment seen in FIG. 6, stud-holder 3 is composed of a holding plate 302 and a lug 301. The holding plate and the cock form a single part here in which an orifice 304 is made. Lug 301 is a free part here cooperating with said holding plate.

Holding plate 302 further includes a deformable bar 305 separating orifice 304 into a first opening 304*a* and a second opening 304*b*. First opening 304*b* is the largest portion and is arranged to cooperate with lug 301. This means that lug 301 is inserted into first opening 304*a*. Second opening 304*b* is used for stud 9. In fact, stud 9 is inserted in second opening 304*b*.

Advantageously according to the invention, the shape of lug 302 and that of first opening 304*a* are such that they can act on deformable bar 305 when lug 302 rotates with respect to the holding plate. This deformation of said bar makes it possible to constrict second opening 34*b* and thereby clamp stud 9.

Figure 7A:
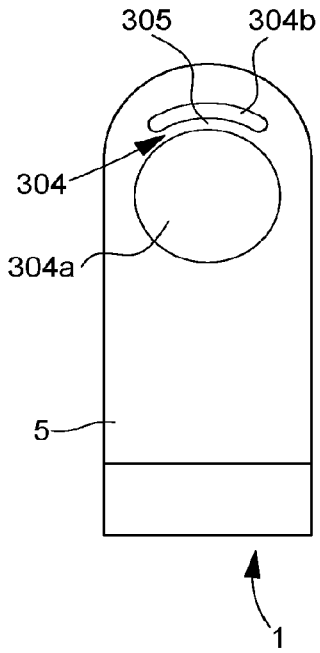
FIGS. 7*a* and 7*b* show a diagram of a first solution of the second embodiment of the holding assembly according to the invention.
Figure 7B:
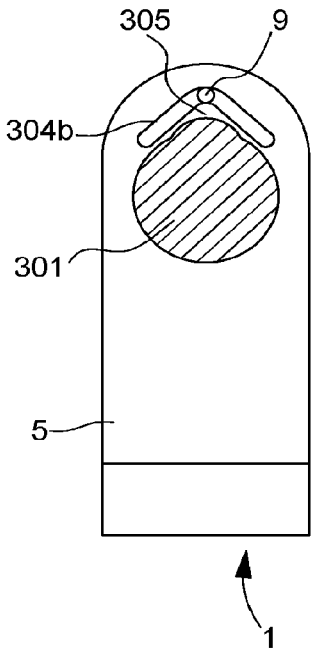

In a first solution seen in FIGS. 7*a* and 7*b*, the first opening 304*a* is devised to have a perfectly circular shape, with second portion 304*b* taking the form of a curved groove. In this first solution, lug 301 takes the form of a part with a non-constant cross-section. More specifically, lug 301 will be made to take the form of a substantially circular part having one area that exhibits a greater distance between the centre of the circle and the end of lug 301, which provides a separate area.

This separate area will be used for clamping stud 9. Indeed, by pivoting lug 301 with respect to holding plate 302, the separate area of lug 301 will enter into contact with deformable bar 305. Given that first opening 304*a* is circular, the separate area of lug 301 exerts stress on deformable bar 305. This stress thus deforms bar 305 which constricts second opening 340*b*. This constriction causes stress to be exerted on stud 9 so as to clamp said stud.

Assembly is achieved by mounting lug 301 on cock 5 and inserting it in first opening 304*a* of holding plate 302. Lug 301 may or may not be mounted in its permanent angular position. In the case where lug 301 is mounted in its permanent angular position, lug 301 will be pivoted at a certain angle clockwise or anticlockwise so that the separate area is no longer in contact with deformable bar 305. The stress applied by this separate area is thus removed and second opening 304*b* returns to its original size allowing assembly of stud 9.

Stud 9 is then placed in second opening 304*b* and lug 301 is rotated with respect to holding plate 302 to constrict second opening 304*b* and clamp stud 9 on holding plate 302.

Lug 301 could be devised as a circular part provided with a projecting portion or a part of ovoid shape.

It is possible to adjust the angular position of stud 9 by sliding it in second opening 304*b*.

Figure 8A:
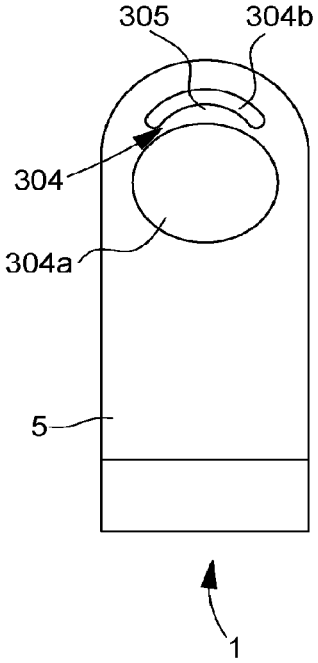
FIGS. 8*a* to 8*c* show a diagram of a second solution of the second embodiment of the holding assembly according to the invention.
Figure 8B:
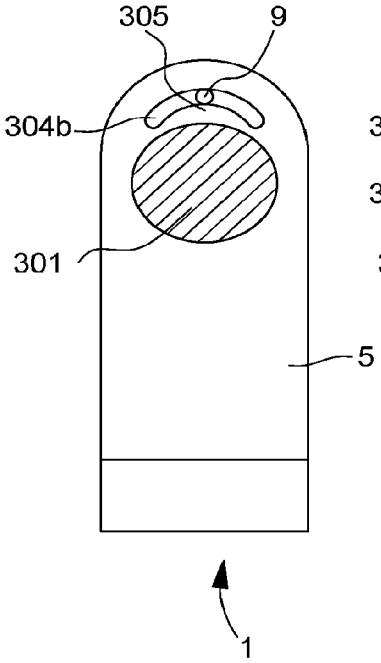
Figure 8C:
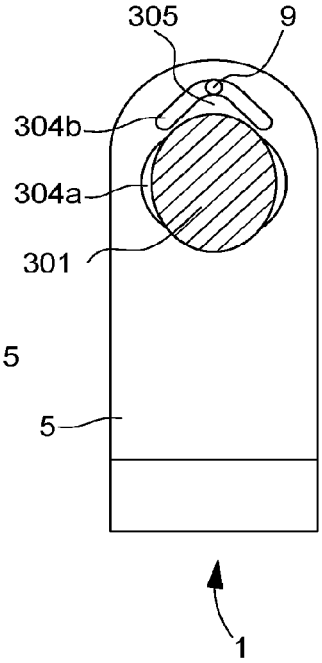

In a first solution seen in FIGS. 8*a*, 8*b* and 8*c*, the first opening 304*a* is devised to have a perfectly ovoid shape, with second portion 304*b* taking the form of a curved groove. This ovoid shape makes it possible to obtain a lug 301 whose external dimensions are different in the x-y plane. The length of lug 301 is greater than its width. In this second solution, lug 301 takes the form of a part of identical cross-section to that of the first opening.

However, first opening 304*a* is arranged such that its length extends perpendicularly to the longitudinal axis of cock 5. Consequently, during assembly of holding plate 302, lug 301 is inserted in the first opening. As a result, the longitudinal axis of lug 301 is in an angularly offset position with respect to alignment with the longitudinal axis of cock 5.

When holding plate 301 is rotated in order to clamp the stud inserted in the second opening, one of the two poles, i.e. one of the two areas farthest from the centre of lug 301, enters into contact with deformable bar 305. Deformable bar 305 is then subjected to stress from lug 301, causing deformation of the bar. This deformation causes a constriction of second opening 34*b* and thus the appearance of stress on stud 9 in order to clamp the stud.

Figure 9:
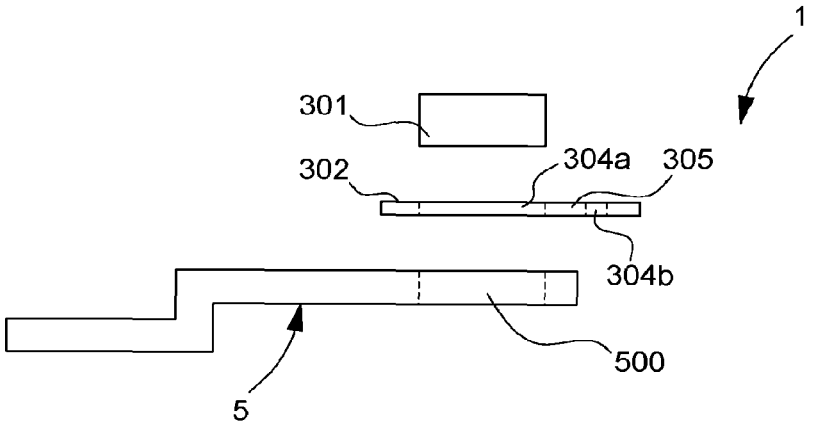
FIG. 9 shows a diagram of a variant of the second solution of the second embodiment of the holding assembly according to the invention.

In a variant seen in FIG. 9, holding plate 302 is a plate that is fixed on cock 5. Cock 5 also includes a through or blind hole 500 identical to first opening 304*a* of holding plate 302. When holding plate 302 is fixed to cock 5, the two openings 304*a*, 500 coincide. This variant advantageously allows the angular position of the holding plate to be modified with respect to that of the cock and thereby allows better positioning of the stud.

A male interface 700 and a female interface 702 are provided for the rotatable mounting of lug 301 with respect to holding plate 302, or of holding plate 32 with respect to lug 31. Male interface 700 and female interface 702 cooperate with each other to mount the movable part to cock 5 through a movement of rotation.

Figure 13:
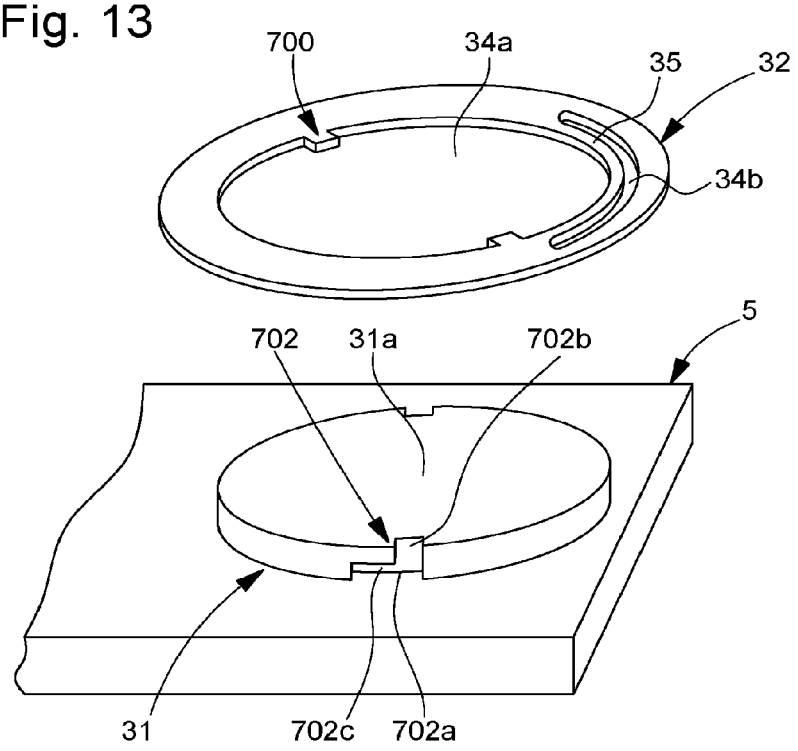
FIG. 13 shows a diagram of an alternative of the first and second embodiments of the holding assembly according to the invention.

According to a first alternative embodiment, the rotatable mounting is a bayonet fitting. In the case of FIG. 13, the lug extends from cock 5 and holding plate 32 is mounted to lug 31. Female interface 702 is arranged on lug 31. This female interface 702 consists of at least one cavity 702*a* comprised in the thickness of lug 31. This cavity 702*a* is formed by a passage 702*b*, which is parallel to said central axis of lug 31 and open on the lower surface of lug 31, and, secant with said first recess and opposite upper surface 31*a*, a blind slot 702*c*. Slot 702*c* is used for the bayonet locking of holding plate 32.

Male interface 700, located at first opening 34*a*, consists of at least one protruding portion 701. This protruding portion 701 is located on the edge of first opening 34*a*. Protruding portion 701 is arranged to cooperate with female interface 702 of the lug.

Holding plate 32 is mounted on lug 31 such that protruding portions 701 of holding plate 32 can be inserted in the passage 702*b* of said lug 31. The lug can then be inserted in the first opening. When the lug reaches an abutment position, the curved arms must be facing the slots. Consequently, a movement of rotation is effected to insert the protruding portions into said slots and to fix said lug to the cock.

According to a second alternative, the rotatable mounting is a screw mounting. To achieve this, the female interface and the male interface both consist of a screw thread.

Figure 10:
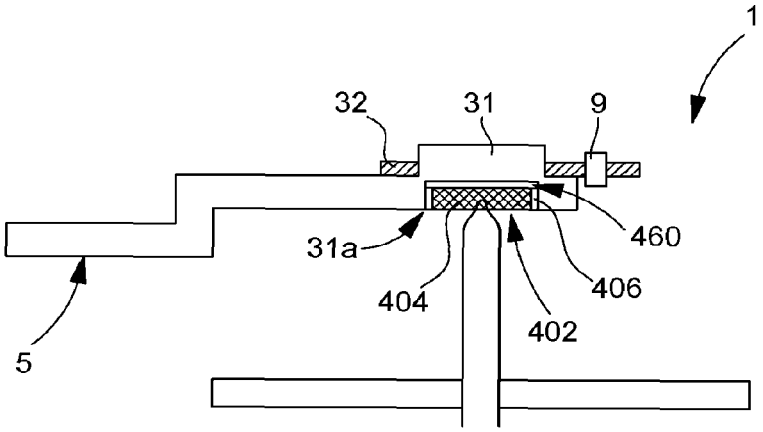
FIGS. 10 and 11 show a diagram of a first variant of the first and second embodiments of the holding assembly according to the invention.
Figure 11:
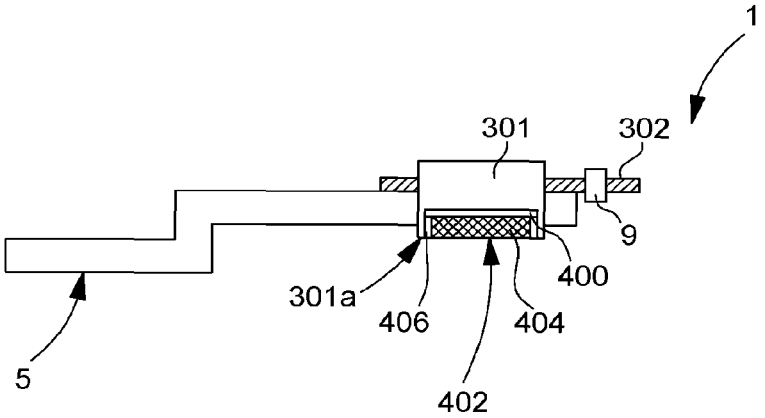

In a first variant of the two embodiments seen in FIGS. 10 and 11, lug 31, 301 includes, on the lower face 31*a*, 301*a* thereof, a recess 400. The recess is for insertion of a shock absorber system 402. The latter may take a conventional form, i.e. a setting in which a jewel hole and an endstone are arranged, or the form of a single jewel 404. This single stone 404 is provided with a recess for cooperating with the balance staff and may be force-fitted in recess 400 by means of an elastic ring 406. The shock absorber system could also take the form of a disc provided with elastic arms. This variant allows for centring between the stud and the balance staff pivot which will cooperate with said shock absorber system. This variant can be developed further by envisaging that lug 301 is itself a shock absorber system. This shock absorber system takes the form of a setting in which a jewel hole and an endstone are arranged.

Figure 12:
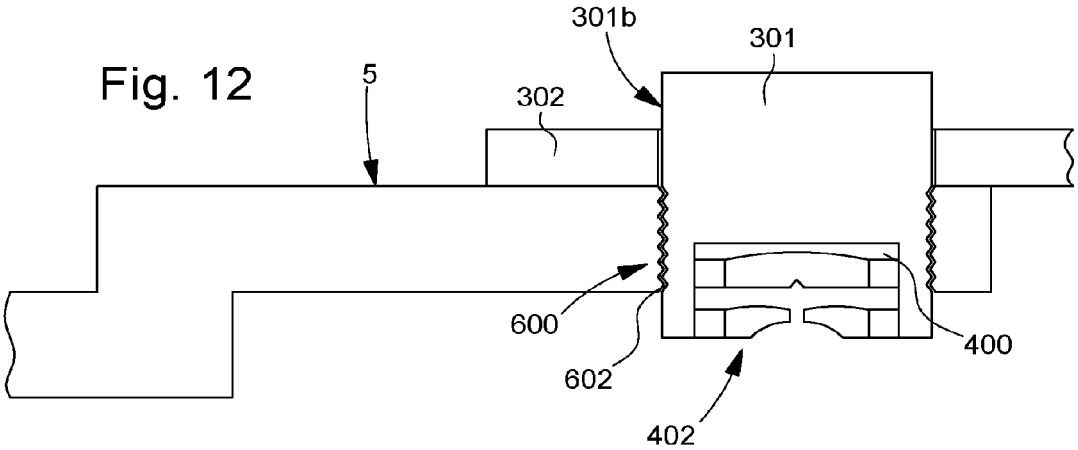
FIG. 12 shows a diagram of a second variant of the first and second embodiments of the holding assembly according to the invention.

In a second variant, seen in FIG. 12, in which lug 301 is a free part provided with a shock absorber system 402, lug 301 is mounted with height adjustment. To achieve this, a thread 600 is arranged in first opening 304*a* in which lug 301 is inserted. Lug 301 then includes a thread 602 on its outer wall 301*b* to cooperate with thread 600 of holding plate 302. The height position of the shock absorber system can thus be adjusted by making more or fewer turns with the lug. It will therefore be understood that a preliminary step to mounting the stud is an adjustment in which the lug is inserted in the first opening of the holding plate and then rotated to adjust the height of the shock absorber system. The next step is then the step of setting in place and clamping the stud.

In a third variant of the first and second embodiments, adjustment means 800 are provided for the angular adjustment of the holding plate to modify the angular position of said holding plate with respect to the cock while continuing to clamp the stud securely.

Figure 14:
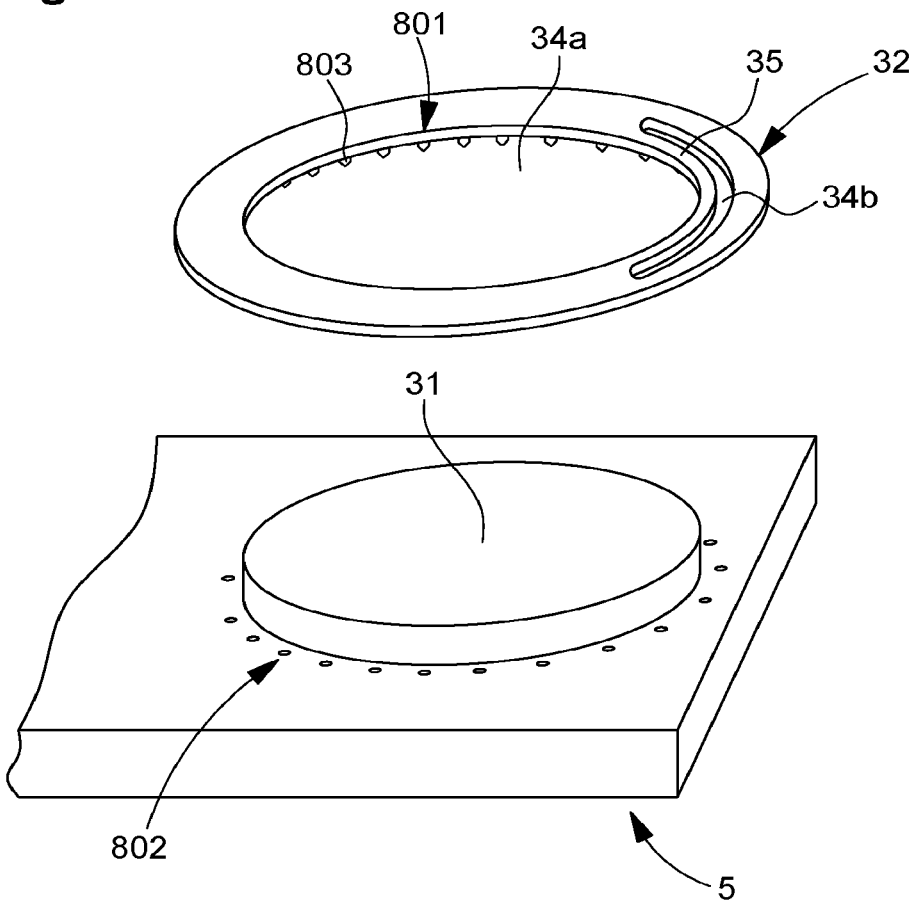
FIGS. 14, 17 and 18 show a diagram of a third variant of embodiments of the holding assembly according to the invention.

In the case of the second embodiment in which lug 301 is a part that is added to the base and holding plate 302 is fixed to cock 5, adjustment means 800 thus includes engagement means 801 arranged on the face of the holding plate opposite the cock and a plurality of receptacles 802 arranged on the face of the cock opposite the holding plate as seen in FIG. 14. For example, engagement means 801 include at least one tube 803 protruding from the face of the holding plate opposite the cock, while the plurality of receptacles include a plurality of holes into which the tubes can be inserted. The fact of having a plurality of tubes 803 ensures hold is maintained even if one of tubes 803 breaks.

Preferably, the plurality of tubes and the plurality of holes are disposed in a circle. This arrangement has the advantage of allowing the angular position of the holding plate to be modified with respect to the cock and of locking this angular position. Once the angular position has been defined and locked, it is possible to perform the steps of setting the stud in place and clamping the stud to the holding plate.

Consequently, since the lug is an added part, said lug simply needs to be inserted in the first holding plate opening and in the cock opening and then rotated to act on the deformable bar of the holding plate in order to clamp the stud.

Figure 17:
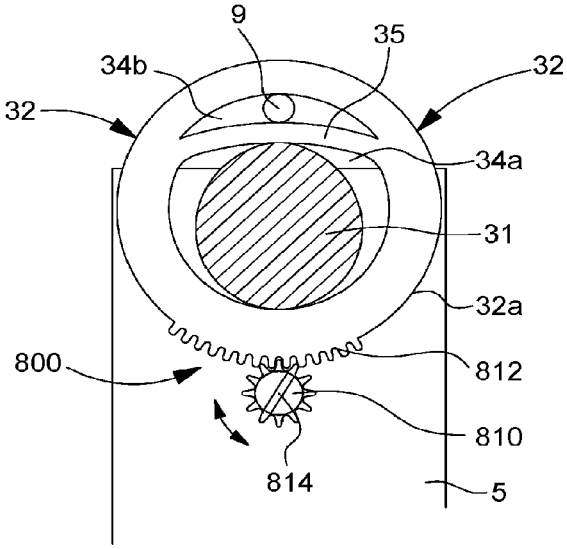

In the case of the first embodiment seen in FIG. 17, angular adjustment means are provided. These adjustment means 800 include a toothed wheel 810 arranged on balance cock 5. This toothed wheel 810 is mounted on an arbor. Toothed wheel 810 is arranged to cooperate with a toothing 812 arranged on the holding plate. More specifically, toothing 812 is arranged on the external wall 32*a* of holding plate 32.

Wheel 810 includes a slot 814 so that a tool, such as a flat-head screwdriver can be used to act on toothed wheel 810.

Thus, in order to modify the angular position of stud 9, a person engages the flat head of the screwdriver in slot 814 of the toothed wheel and rotates toothed wheel 810. Toothed wheel 810 meshes with toothing 812 of the holding plate, causing the latter to rotate.

Figure 18:
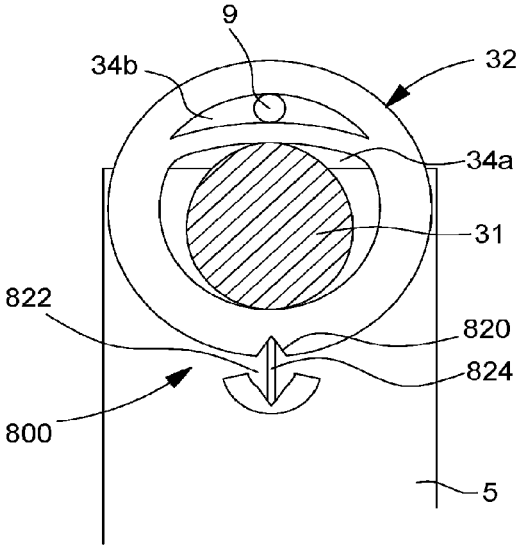

It is possible to envisage that adjustment means 800 include a second notch 822 arranged on the holding plate and a first notch 820 arranged on balance cock 5, as seen in FIG. 18. These notches are located opposite each other so that it is possible to place the flat head of a screwdriver in both notches. This arrangement makes it possible to pivot the holding plate by pivoting screwdriver 824 on itself. Simple and inexpensive means for angular adjustment of the holding plate are thus obtained.

Further, in another variant, it will be understood that lug 31 and holding plate 32 or holding plate 302 and lug 301 are arranged on the lower face of cock 5, i.e. on the face located opposite the sprung balance.

Figure 15A:
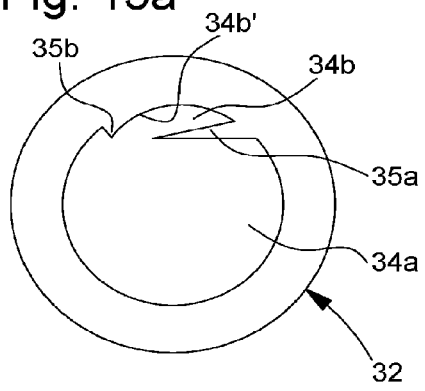
FIGS. 15*a*, 15*b*, 16*a* and 16*b*, 19*a* and 19*b* show a diagram of another variant of embodiments of the holding assembly according to the invention.
Figure 15B:
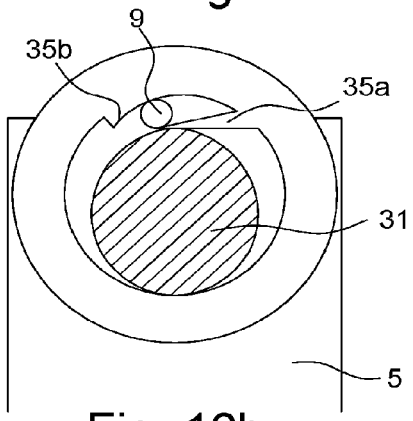
Figure 16A:
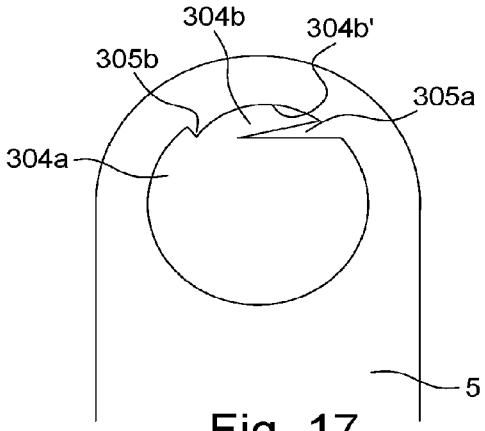
Figure 16B:
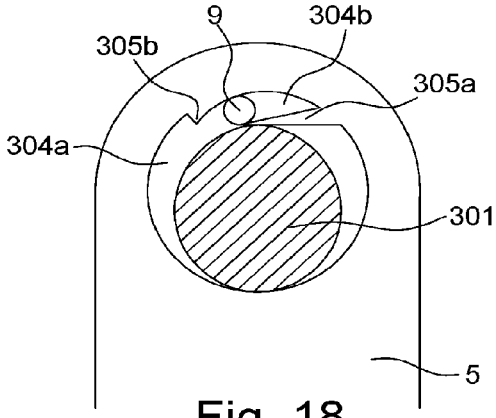

In another variant seen in FIGS. 15*a*, 15*b*, 16*a*, 16*b*, the orifice 34, 304 of holding plate 32 seen in FIGS. 15*a*, 15*b*, or of balance cock 5 seen in FIG. 16*a*, 16*b*, is separated into a first opening and a second opening by a deformable arm 35*a*, 305*a* having one end connected to the wall of orifice 34, 304 and one free end. The wall of orifice 34, 304 also includes an extension 35*b*, 305*b* which may have any shape. This extension makes it possible, during assembly of the stud, for the elastic arm to press the stud against the wall of the second opening 34*b*', 304*b*' and against the wall of the extension to lock said stud as seen in FIGS. 15*b* and 16*b*.

Figure 19A:
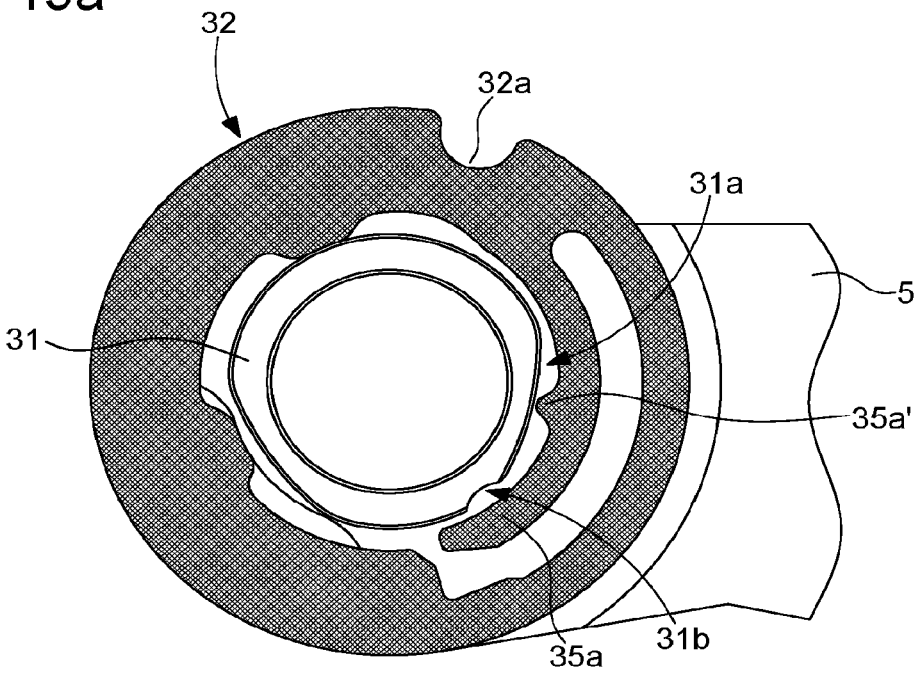
Figure 19B:
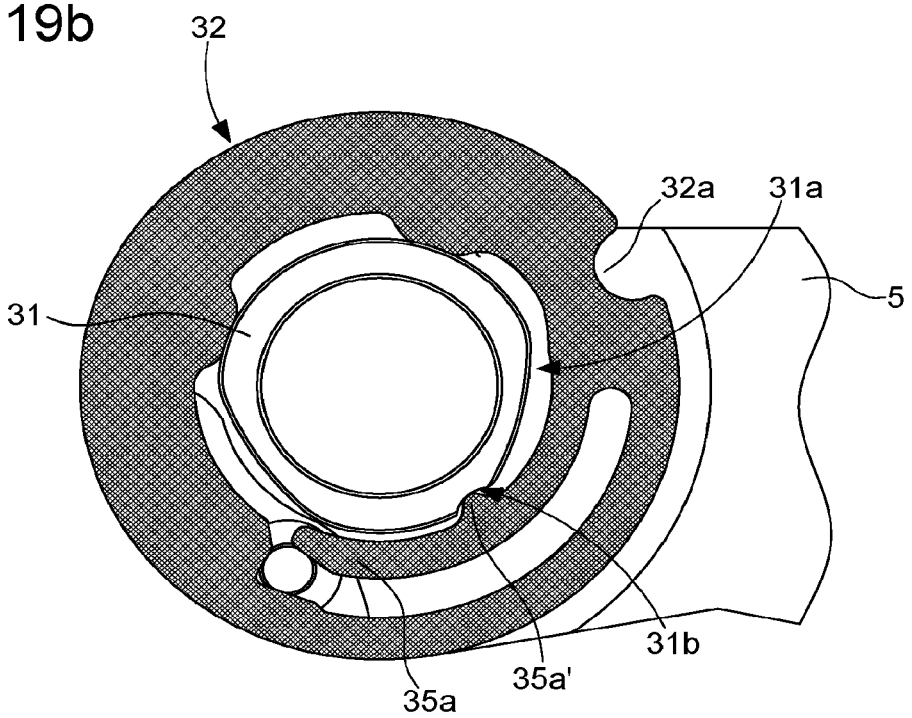

In this regard, a variant could be provided wherein the deformable arm includes a bump or protuberance 35*a*' as seen in FIGS. 19*a* and 19*b*. This bump or protuberance cooperates with lug 31. Indeed, cleverly, lug 31 is circular but has a flat portion 31*a*. Elastic arm 35*a* is then arranged so that, when it is opposite the flat portion, said arm 35*a* is released so that the stud can be easily placed therein. When holding plate 32 is rotated to lock stud 9, the bump of elastic arm 35*a* remains in contact with the wall of lug 31 so that the variation in thickness of lug 31 between the flat portion and the rest of the periphery thereof exerts stress on elastic arm 35*a*. This stress is intended to move the elastic arm closer to the wall of orifice 34, 304. The stud is thus held in place by said elastic arm. A notch 31*b* may be envisaged on said lug 31 to lock the angular position of holding plate 32. This configuration allows the bump to be used as a marking for viewing the angular position of the stud-holder.

It will be clear that various alterations and/or improvements and/or combinations evident to those skilled in the art may be made to the various embodiments of the invention set out above without departing from the scope of the invention defined by the annexed claims.

Further, it is possible to achieve the angular adjustment of the holding plate on the cock by providing two oblong holes on said holding plate. These two oblong holes allow the holding plate to be fixed on the cock while permitting a degree of freedom in rotation. Preferably, the oblong holes will be made such that the holding plate can be rotated about the lug.

Holding plate 32 could also be provided with at least one notch 32*a* on the periphery thereof, as seen in FIGS. 19*a* and 19*b*. This notch simply allows a tool, such as a screwdriver or tweezers, to be used for rotating the holding plate. In the case of the use of tweezers, two diametrically opposite notches may be provided.

Likewise, lug 301 acting as a shock absorber could be used as a stop member in the Z direction for retaining the stud-holder in the event of shocks.

What is claimed is:

1. An assembly for holding or supporting a timepiece balance spring, including a balance spring stud and a stud-holder, wherein the stud-holder includes:

a base comprising an upper face and a lower face extending along a longitudinal axis;

wherein the base comprises a lug forming a protuberance from one of said faces, said assembly further comprising a holding plate including a first opening and a second opening separated by a deformable arm, the stud engaging in the second opening, said first opening being arranged to cooperate with the lug, the cross-section of the lug having a shape such that a rotation of said holding plate causes a deformation of the deformable arm constricting the second opening and clamping the stud.

2. The assembly for holding or supporting a timepiece balance spring, including a balance spring stud and a stud-holder, wherein the stud-holder includes:

a base comprising an upper face and a lower face extending along a longitudinal axis and a first opening;

wherein the base includes a second opening separated from said first opening by a deformable arm, the stud engaging in the second opening, said assembly further including a lug arranged to cooperate with said first opening, the cross-section of the lug has a shape such that a rotation of the lug causes a deformation of the deformable arm constricting the second opening and clamping the stud.

3. The assembly for holding or supporting a timepiece balance spring, including a balance spring stud and a stud-holder, wherein the stud-holder includes:

a base comprising an upper face and a lower face extending along a longitudinal axis and a hole;

wherein the base includes a holding plate provided with a first opening and a second opening separated by a deformable arm, the stud engaging in the second opening, said assembly further including a lug arranged to cooperate with said first opening and the hole allowing the holding plate to be fixed on the base, the shape of the cross-section of said lug having such that a rotation of the lug causes a deformation of the deformable arm constricting the second opening and clamping the stud.

4. An holding assembly according to claim 1, wherein the first opening is circular, said lug taking the form of a cylindrical part wherein at least one area of the outer wall has a protuberance for application of stress on the deformable arm to reduce the size of the second opening.

5. The holding assembly according to claim 2, wherein the first opening is circular, said lug taking the form of a cylindrical part wherein at least one area of the outer wall has a protuberance for application of stress on the deformable arm to reduce the size of the second opening.

6. The holding assembly according to claim 3, wherein the first opening is circular, said lug taking the form of a cylindrical part wherein at least one area of the outer wall has a protuberance for application of stress on the deformable arm to reduce the size of the second opening.

7. The holding assembly according to claim 1, wherein the first opening and said lug have an elliptical shape, the main axis of said lug being offset angularly with respect to the longitudinal axis of the base for application of stress on the deformable arm to reduce the size of the second opening.

8. The holding assembly according to claim 2, wherein the first opening and said lug have an elliptical shape, the main axis of said first opening being offset angularly with respect to the longitudinal axis of the base for application of stress on the deformable arm to reduce the size of the second opening.

9. The holding assembly according to claim 3, wherein the first opening and said lug have an elliptical shape, the main axis of said first opening being offset angularly with respect to the longitudinal axis of the base for application of stress on the deformable arm to reduce the size of the second opening.

10. The holding assembly according to claim 1, wherein the base includes a recess in which a shock absorber system is placed.

11. The holding assembly according to claim 10, wherein the recess is placed such that the central axis of the recess coincides with the axis of the lug.

12. The holding assembly according to claim 2, wherein the lug includes a recess in which a shock absorber system is placed.

13. The holding assembly according to claim 3, wherein the hole in the base is blind, said base comprising a recess positioned such that the central axis of the recess coincides with the axis of the lug, in which a shock absorber system is placed.

14. The holding assembly according to claim 1, wherein said assembly further includes a male interface arranged on the holding plate and a female interface arranged on said lug in order to secure the holding plate to said lug.

15. The holding assembly according to claim 2, wherein said assembly further includes a male interface arranged on the base and a female interface arranged on said lug in order to secure the lug to said base.

16. The holding assembly according to claim 3, wherein said assembly further includes a male interface arranged on the holding plate and a female interface arranged on said lug in order to secure the lug to said base.

17. The holding assembly according to claim 14, wherein the male interface and the female interface are screw pitches.

18. The holding assembly according to claim 15, wherein the male interface and the female interface are screw pitches.

19. The holding assembly according to claim 16, wherein the male interface and the female interface are screw pitches.

20. The holding assembly according to claim 14, wherein the female interface comprises in the thickness thereof at least one cavity formed by a passage which is parallel to the central axis of the lug and open on the lower surface of the lug, and, secant with said first passage and opposite the upper surface, a blind slot used for locking the holding plate in a bayonet fitting.

21. The holding assembly according to claim 16, wherein the female interface comprises in the thickness thereof at least one cavity formed by a passage which is parallel to the central axis of the lug and open on the upper surface of the lug, and, secant with said first passage and opposite the lower surface, a blind slot used for locking the holding plate in a bayonet fitting.

22. The holding assembly according to claim 1, wherein the holding assembly further includes adjustment means comprising a toothed wheel arranged on a balance cock cooperating with a toothing arranged on the holding plate, said wheel being provided with a slot so that a tool can rotate said toothed wheel, causing the holding plate to rotate.

23. The holding assembly according to claim 1, wherein the holding assembly further includes adjustment means comprising a first notch arranged on a balance cock and a second notch arranged on the holding plate, the first notch and the second notch being arranged such that a tool inserted in the first and second notch can rotate the holding plate with respect to the balance cock.

* * * * *